United States Patent [19]

Crise

[11] 4,141,103

[45] Feb. 27, 1979

[54] CLEANER USING HIGH VELOCITY AIR JETS HAVING A DOUBLE VALVE

[76] Inventor: W. Paul Crise, 4921 NE. 2nd Ave., Pompano Beach, Fla. 33064

[21] Appl. No.: 786,257

[22] Filed: Apr. 11, 1977

[51] Int. Cl.[2] ..... A47L 5/14

[52] U.S. Cl. ..... 15/346; 15/404

[58] Field of Search ..... 15/345, 346, 404, 405, 15/421

[56] References Cited

U.S. PATENT DOCUMENTS

| | | | |
|---|---|---|---|
| 2,321,648 | 6/1943 | Brunner | 15/404 |
| 2,864,119 | 12/1958 | Crise | 15/404 |
| 3,107,386 | 10/1963 | Mandin | 15/345 |
| 3,268,942 | 8/1966 | Rossnan | 15/346 |

FOREIGN PATENT DOCUMENTS

| | | | |
|---|---|---|---|
| 494500 | 3/1930 | Fed. Rep. of Germany | 15/404 |

*Primary Examiner*—Christopher K. Moore
*Attorney, Agent, or Firm*—Malin & Haley

[57] ABSTRACT

This disclosure shows the supplying of fluid at a pressure greater than the pressure of the surrounding atmosphere to a cleaner in which the cleaning is done by intermittently and consecutively jetting fluid, from a double distributing valve against the surface of the material being cleaned, where the total average pressure of the air or gas is maintained at a few inches of water below the pressure of the surrounding atmosphere.

6 Claims, 10 Drawing Figures

Fig.1.
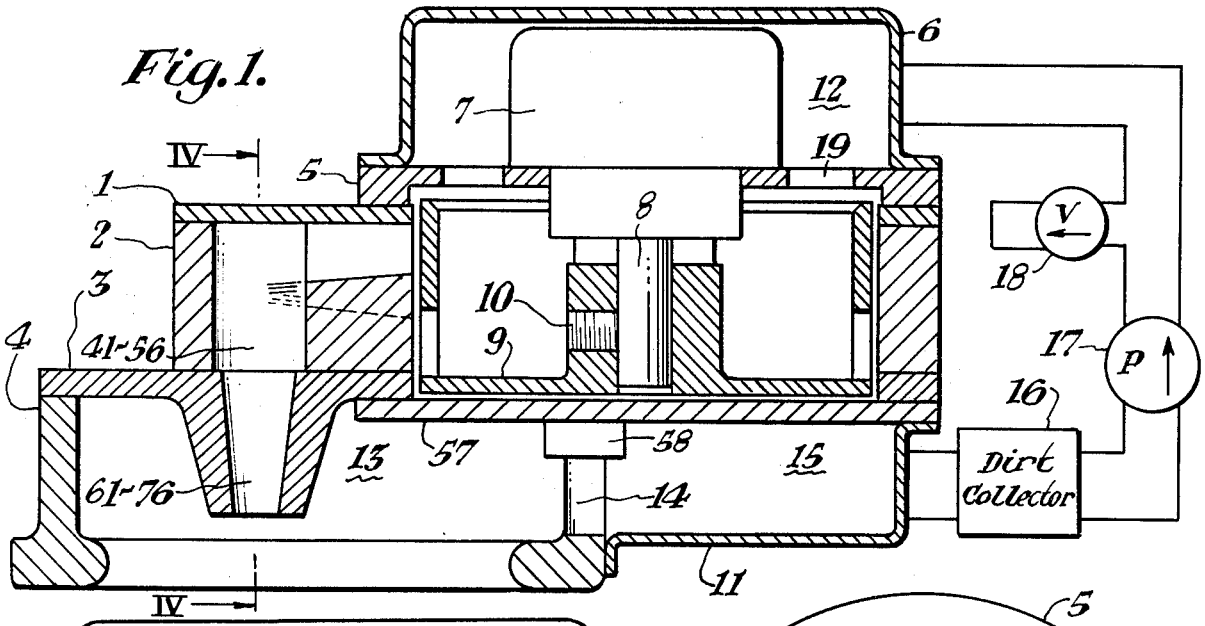
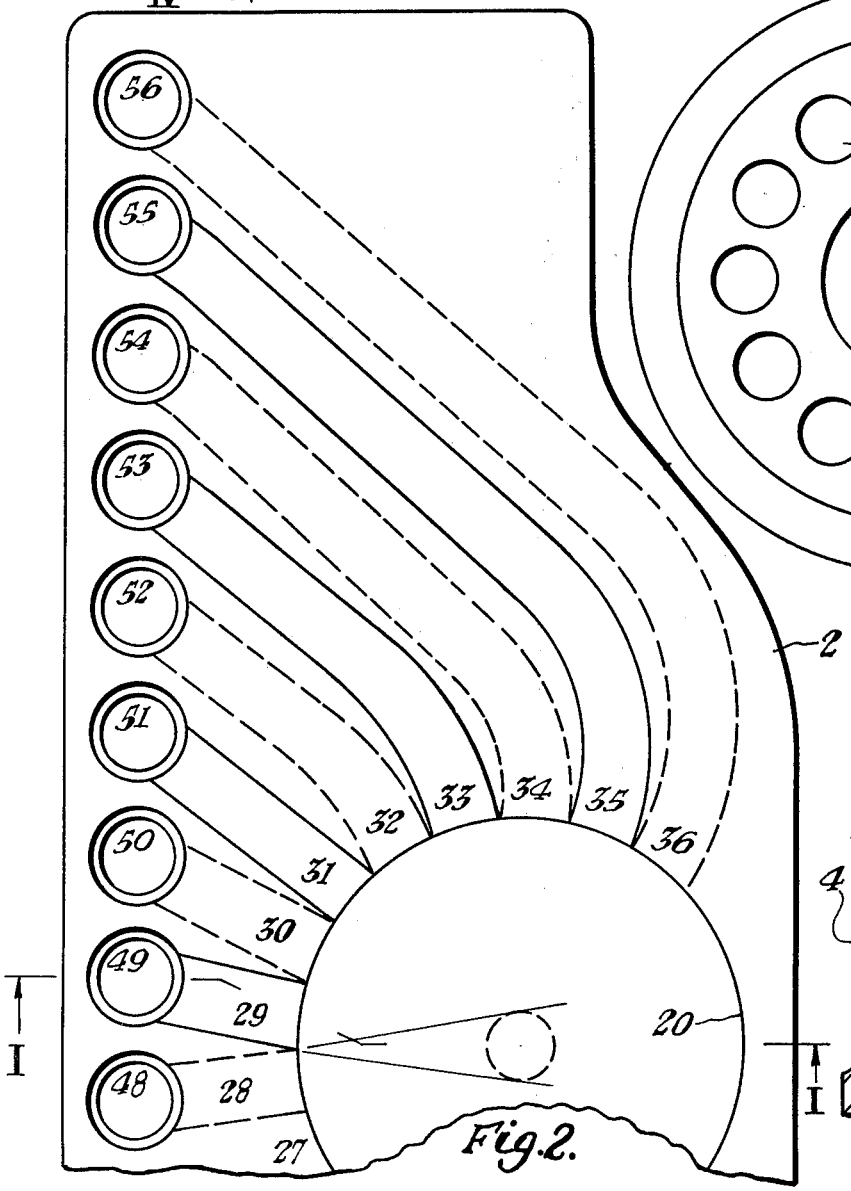
Fig.2.
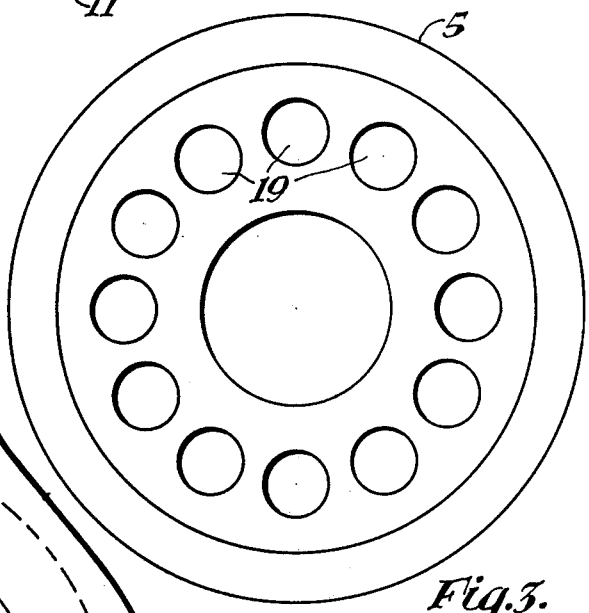
Fig.3.
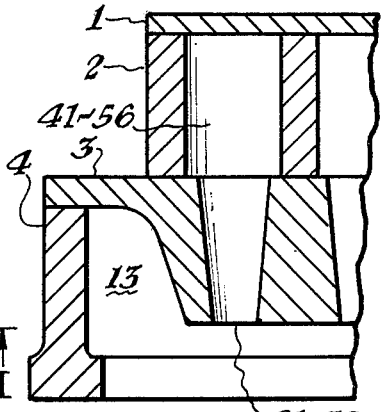
Fig.4.

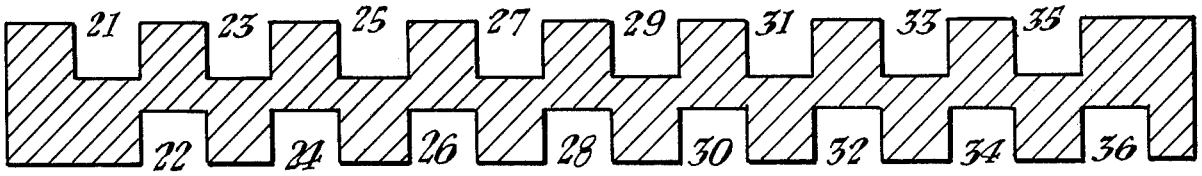
Fig.5.
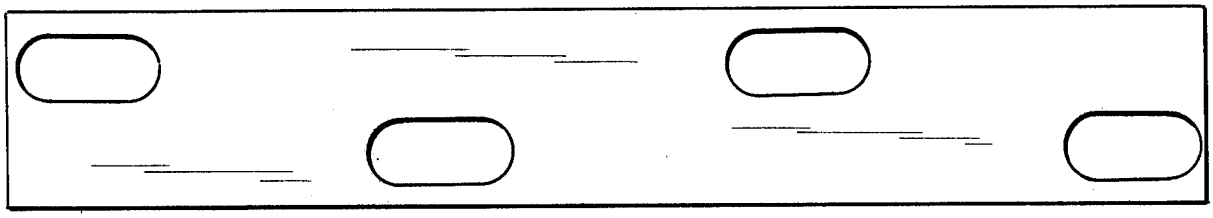
Fig.6.
Fig.7.
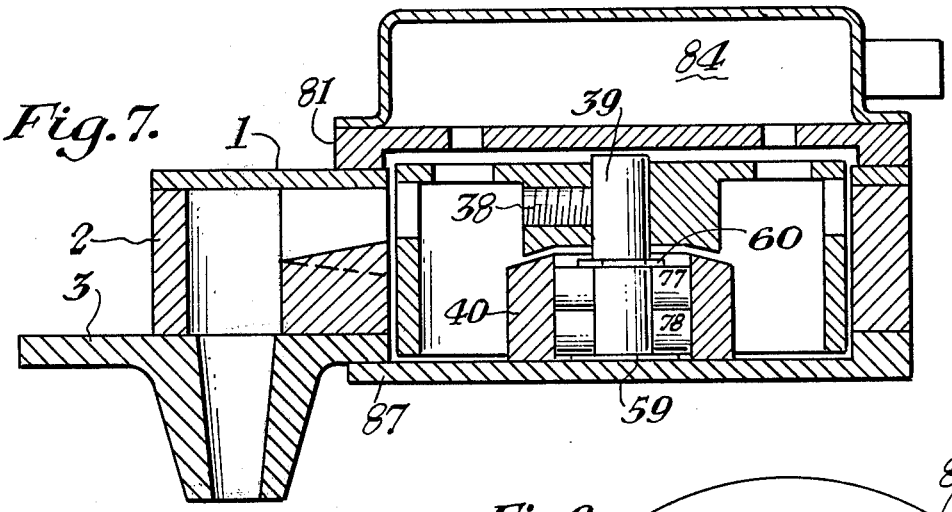
Fig.8.
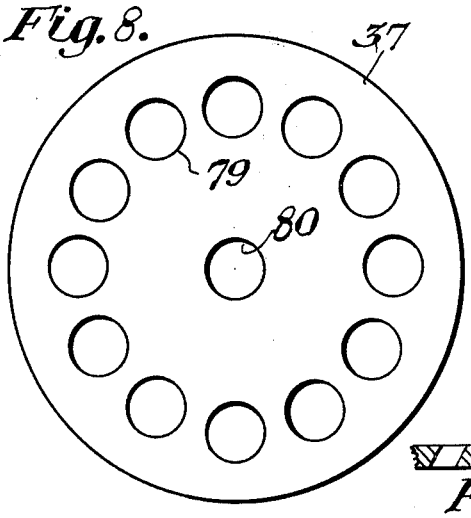
Fig.9.
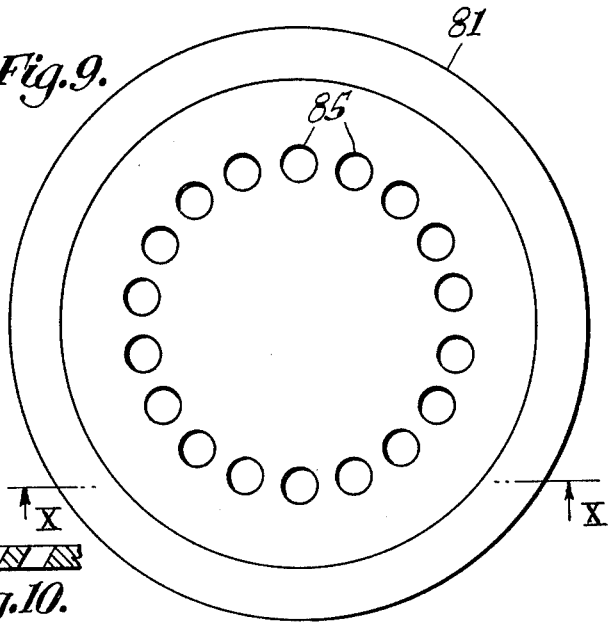
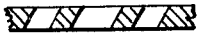
Fig.10.

CLEANER USING HIGH VELOCITY AIR JETS HAVING A DOUBLE VALVE

BACKGROUND OF THE INVENTION

Various types of cleaners are commonly used to supply intermittent jets of fluid for cleaning carpet. One such device is the invention disclosed in my U.S. Pat. No. 2,864,119. Another device is my invention disclosed in U.S. Pat. No. 4,017,938.

SUMMARY OF THE INVENTION

This invention relates generally to a cleaner that supplies intermittent jets of fluid for cleaning carpets, more particularly to a cleaner using a double distributing valve, one valve located above the other. This double valve makes possible a substantially larger, more effective and efficient cleaner. A single member, of molded plastic, is the circular portion of the rotor cavity for the single rotor, that has discharge openings that register with and supply air independently to both the top and bottom sections of the stator. The above mentioned, single member, of molded plastic, also contains all the passages that connect the rotor cavity to all of the jet nozzle passages. In this cleaner the passages leading from the valve rotor cavity to the space above the jet nozzle passages do not increase in width after they leave the valve rotor cavity; instead they increase in depth as the passages become longer and do so as a function of the length of the passages. Since the passages leading from the valve rotor cavity do not increase in width, much less horizontal space is required by these passages and the jet nozzle passages may be placed closer together. The upper portion of the double valve supplies air to the odd numbered jet nozzle passages and lower portion of the valve to the alternate even numbered jet nozzle passages. By this arrangement, air from a jet nozzle passage is never interfered with by air flowing from an adjacent passage. Also, the double valve doubles the space available for the passages leading from the valve rotor cavity to the jet nozzle passages, greatly increasing the efficiency of the cleaning tool. The double valve makes it easy to produce a larger cleaning tool that is more effective and efficient and with the jet nozzle passages close enough together so that one pass over the material being cleaned will do a good job of cleaning. Other features of this invention are disclosed in the drawings and the specification.

BRIEF DESCRIPTION OF THE DRAWINGS

FIG. 1 is a side view in section, taken along line 1—1 of FIG. 2. In this view, the rotor of the double valve is rotated by an electric motor.

FIG. 2 is a top view of 2. 2 is planned to be molded as a single piece of plastic, the top and bottom portions being identical.

FIG. 3 is a bottom view of 5.

FIG. 4 is a partial right front view of the cleaning tool in section, taken along line 4—4 of FIG. 1.

FIG. 5 shows the sixteen passages 21 through 36 in 2 that lead from the valve rotor cavity in 2 to the spaces 41 through 56 in 2 above the jet passages 61 through 76 in 3.

FIG. 6 shows the outside surface of rotors 9 and 37 and the location of the four elongated openings through the outer wall of 9 and 37.

FIG. 7 is a partial side view of the cleaning tool, having a double valve that is rotated by the air that passes through it and which it distributes, in section taken along 1—1 of FIG. 2.

FIG. 8 is a top view of 37.

FIG. 9 is a bottom view of 81.

FIG. 10 is a partial view in section taken along line 10—10 of 81 and shows how the holes in 81 pass through it at an angle of approximately 30 degrees.

DESCRIPTION OF THE PREFERRED EMBODIMENT

As shown in FIG. 1, the top and bottom surfaces of 1, 2, 3, 4, 5 and 57 should be flat and smooth so that when fastened together they would make substantially air tight contact. The bottom of 9 should also be flat and smooth. A gasket may be used to assist 6 to make air tight contact with 5 and may be used to assist 11 to make air tight contact with 4 and 57.

1 can be stamped from ⅛ inch aluminum sheet and its horizontal dimensions are the same as 2 as is shown in FIG. 2. 2 is a single member, of molded plastic, containing the passages 21–36 that connect the rotor cavity to all of the jet nozzle passages 61–76. In this cleaner the passages 21–36 leading from the valve rotor cavity to the space above the jet nozzle passages 61–76 do not increase in width after they leave the valve rotor cavity; instead they increase in depth as the passages become longer and do so as a function of the length of the passages. Since the passages leading from the valve rotor cavity do not increase in width, much less horizontal space is required by these passages and the jet nozzle passages may be placed closer together. 3 can be die cast of aluminum or molded of good plastic. Its horizontal dimensions are the same as 1 and 2, except it is about 2 13/16 inches longer than 1 and 2, as is shown in FIG. 4, the overall width of the cleaning tool being about 15 inches. After 1, 2 and 3 are fastened together, the vertical hole through them should be bored or broached to size.

Electric motor 7 used to rotate valve rotor 9, as shown in FIG. 1 is not intended to show how a suitable motor looks, but to indicate where it would be located and how it would be connected to valve rotor 9 by shaft 8. A suitable electric motor for this purpose could be a two pole shaded pole motor. Its speed would be a little over 3000 RPM. This type of motor is in common use for light duty and has but one insulated winding located on the stator of the motor and requires no brushes or commutator.

5, as shown in FIGS. 1 and 3 has a shallow circular cavity of about 3 1/16 inches in diameter and 12 holes of about 7/16 of an inch in diameter that allow air to flow freely from space 12 to the open end of cup shaped rotor 9. 5 also has a larger hole in its center of a diameter that allows electric motor 7 to slip freely but snugly through. When electric motor 7 is in place in 5, said motor 7 should be firmly fastened to 5. When the sub-assembly of 5, 6, 7 and 9 is being fastened to 1, it may be necessary to move the sub-assembly slightly in a horizontal direction to center the valve rotor in the cylindrical part of the valve rotor cavity made up of 1, 2 and 3. This can be done by using screws passing through holes in 5 and 6 into matching tapped holes in 1, the diameter of the holes in 5 and 6 being made larger than the diameter of the screws to provide for the needed adjustment.

The double valve rotor 9 is a cup shaped member having a hub extending upward from the bottom of the cup. As shown in FIG. 6, the outer wall of the rotor has four elongated openings through it spaced 90 degrees apart and positioned vertically so that they register alternately with the odd or even numbered passages 21 through 36 as shown in FIG. 5. The hole through the center of the hub of 9 should have such a size that the hub can slip freely but snugly over shaft 8 of electrical motor 7. Tapped hole 10 in the hub of 9 should be provided with a suitable set screw.

57 should be about 3¾ inches square and about ⅛ inch thick and made from aluminum or other suitable material. 4 is a rectangular member of die case aluminum or other suitable material having outside dimensions of about 3⅞ inches wide, 15 inches long and 1¼ inches high. It has a substantially rectangular opening through its lower portion about 2 5/8 inches wide and about 13¾ inches long. The rear portion of 4 has a notch in its center. The top of the notch is about 3¾ inches wide by about ⅛ of an inch deep to allow 57 to slip down in it when 4 is being fastened to 3. In the center of this notch it is increased in depth about ¾ of an inch to make passage 14 that connects space 13, above where the cleaning by the high velocity jets of air takes place, to space 15 in the exhaust manifold. 58 is a piece of aluminum or other suitable material about 2 inches long and about ¼ inch deep by about ½ inch wide. It is fastened to the top of passage 14 to reduce its cross sectional area of the passage, so that the velocity of the air flowing through it will be high enough to carry the dirt loosened by the high speed jets with it.

The portion of 3 that extends about ¾ of an inch down from the flat portion of 3 that rests on 4, contains sixteen jet nozzle passages 61 through 76. These passages have an inside diameter of about 5/16 of an inch at their lower end. This diameter increases as the passages extend upward at an included angle of approximately 10 degrees.

As previously noted, FIG. 7 is a partial side view in section taken along line 1—1 of FIG. 2 of a cleaning tool, having a double valve, the rotor of which is rotated by the air that passes through it and which it distributes. Many of the parts used in this cleaner are identical to parts used in the cleaner shown in FIG. 1, using a double valve, the rotor of which is rotated by an electric motor. 1, 2 and 3 shown in FIG. 7 are identical; 4–58 and 11 not shown are identical and all that is shown in FIGS. 2, 4, 5 and 6 are identical. 87 shown in FIG. 7 has the same overall dimensions as 57 in FIG. 1.

87 is a piece of aluminum or other suitable material about 3¾ inches square and about ⅛ inch thick. 87 is fastened to 3 by screws passing through holes in 87 into matching tapped holes in 3. The diameter of the holes in 87 are larger than the diameter of the screws, so that 87 can be adjusted horizontally before the screws are tightened. As shown in FIG. 7, 40 is made of aluminum or other suitable material and has an outside diameter of about 1½ inches and an inside bore of about ⅞ of an inch to fit the outside diameter of ball bearings 77 and 78. The lower end of 40 should be square with its inside bore and have a smooth finish. 40 should be located in the center of 87 and firmly fastened to it. Bearings 77 and 78 could be Nice 1604DS double shield bearings. 59 is a thin spacer having an outside diameter of about ⅞ of an inch. 39 is a piece of about ⅜ inch diameter drill rod and has a groove in it as shown in FIG. 7, in which retaining ring 60 is placed. Valve rotor 37 as shown in FIGS. 7 and 8 is an upside down cup shaped member with an outside diameter of about 2 31/32 inches. Its outside wall has four elongated openings through it located as shown in FIG. 6. As shown in FIG. 7 and FIG. 8 which is a top view of rotor 37 shows twelve holes about ⅜ inches in diameter through the top of 37. Hole 80 through the center of 37 should be of a size to slip easily but snugly over shaft 39. Tapped hole 38 through the hub of rotor 37 should be supplied with a suitable set screw. The shallow circular cavity in 81 as shown in FIG. 9 should have a diameter of about 3 1/16 inches. FIG. 10 is a partial view in section taken along line 10—10 of FIG. 9 and shows how eighteen holes about 7/32 inches in diameter pass through 81 at an angle of about 30 degrees. The cleaning tool having a double valve, the rotor of which is rotated by the air that passes through it and which it distributes as shown in FIG. 7, is assembled in the same way as the cleaning tool shown in FIG. 1, except the locating of the valve rotor in the valve rotor cavity is done by adjusting the member that is the bottom of the valve rotor cavity horizontally instead of the top member of the valve rotor cavity.

The use of two small ball-bearings, one above the other, instead of one larger bearing has important advantages. The smaller bearings have less axial play and with the shaft being supported by two bearings, one above the other, the valve rotor will rotate more smoothly and with less tendency to wobble than if it were supported by a larger and much more expensive precision bearing. By requiring less horizontal space, more space for air flow is available. The use of more vertical space is not a problem since the double valve also requires more vertical space. Fafnir and other manufacturers manufacture similar size bearings but Nice is also precision ground and adequate for the extremely light loading in this application.

In the cleaning tool shown in a side view in section in FIG. 1, its double valve rotor is rotated by an electric motor. In the cleaning tool shown in a partial side view in section in FIG. 7, its double valve rotor is rotated by the air that passes through it and that it distributes. In the cleaning tool using a double valve, the valve rotor could be rotated by other means than those shown in the drawings and the specification, such as by an air driven turbine or by the wheels that support the cleaning tool being connected to the valve rotor by suitable gearing. Considering the above, and since U.S. Pat. No. 2,864,119 covering the rotating of the valve rotor by the air that flows through it and which it distributes, had been issued for 17 years on Dec. 24, 1975, this patent is no longer in effect, and that the restricting statement, that the valve rotor is rotated by the air that flows through it, is not necessary to make a claim patentable.

The drawings and the specification show a preferred form of this invention. The double valve has made much better use of space and material and has made possible a more effective cleaning tool than is possible with a single valve. Modifications can be made of this invention and are a part of it. For example, a three level valve could be used and the passages leading from the valve rotor cavity to the space above the jet leading from the valve rotor cavity to the space above the jet nozzle passages could increase in width as the passages become longer. The scope of the invention will be further defined by the claims.

I claim:

1. A cleaning tool for carpet or material, including, an elongated member connected throughout its length with a normally substantially horizontal elongated opening, adapted to engage the surface of the material being cleaned; an elongated cavity, permanently open to the opening, and ending as an outlet opening, said elongated member having a plurality of nozzle passages for discharging gas from a valve rotor cavity against the material being cleaned, positioned above where the elongated opening engages the surface of the material, and spaced longitudinally, along the length of said member, said outlet opening connected to the inlet of a gas moving means; a cylindrical valve rotor cavity, connected through inlet passages from the outlet of said gas moving means to an inlet manifold, and having a plurality of outlet passages spaced around the circumference of said rotor cavity, arranged in a plurality of rows one row above the other leading away from it, each outlet passage connecting separately to at least one of the nozzle passages for discharging jets of gas from said valve rotor cavity against the material being cleaned, said outlet passages leading from the cylindrical valve rotor cavity to the nozzle passages being so proportioned that the areas of their cross sections vary substantially in proportion to a function of their length, the areas of their cross sections increasing gradually as the passages leave the valve rotor cavity, until the areas of their cross sections reach the desired values; a rotatable valve member positioned in said valve rotor cavity wherein the improvement comprises:

a plurality of outer wall openings of said valve rotor member arranged in a plurality of rows one row above the other, positioned vertically so that said openings in the outer wall of said rotor will be on the same level as that of the outlet passages leading from the valve rotor cavity to the jet nozzle passages, said openings in the outer wall of the valve rotor being so positioned around its circumference that when rotated the jet nozzle passages will receive gas in the desired order;

said valve rotor being connected to means adapted to rotate the valve rotor at the desired speed.

2. A cleaning tool as set forth in claim 1 wherein said openings in the outer wall of said valve rotor member are arranged in two vertically positioned rows.

3. A cleaning tool as set forth in claim 1 wherein said outlet passages around the circumference of said rotor cavity are arranged in two vertically positioned rows in substantially the same plane as said openings in the outer wall of said valve rotor member.

4. A cleaning tool as set forth in claim 1 wherein said valve rotor rotating means includes a motor.

5. A cleaning tool as set forth in claim 1 wherein said gas moving means is a gas pump whereby the inlet of said gas pump is connected to said outlet opening and the outlet of said gas pump is connected to said inlet manifold.

6. A cleaning tool as set forth in claim 1 further comprising a dirt collector positioned between said inlet of said gas pump and said outlet opening.

* * * * *